US008382493B2

(12) United States Patent
Ruffner

(10) Patent No.: US 8,382,493 B2
(45) Date of Patent: Feb. 26, 2013

(54) THREE-POLE ADAPTER SET WITH A PLUG PART AND A SOCKET PART WHICH MAY BE PLUGGED IN THE PLUG PART

(76) Inventor: Walter Ruffner, Jolly Harbour (AG)

( * ) Notice: Subject to any disclaimer, the term of this patent is extended or adjusted under 35 U.S.C. 154(b) by 0 days.

(21) Appl. No.: 12/999,982

(22) PCT Filed: Jun. 16, 2009

(86) PCT No.: PCT/CH2009/000204

§ 371 (c)(1),
(2), (4) Date: Dec. 17, 2010

(87) PCT Pub. No.: WO2009/152629

PCT Pub. Date: Dec. 23, 2009

(65) Prior Publication Data

US 2011/0086527 A1 Apr. 14, 2011

(30) Foreign Application Priority Data

Jun. 17, 2008 (CH) ..... 0923/08

(51) Int. Cl.
*H01R 4/66* (2006.01)

(52) U.S. Cl. ..... 439/105

(58) Field of Classification Search ..... 439/105, 439/106, 107, 957, 131, 694, 170, 166, 172, 439/137, 13, 135, 108, 101, 638, 217, 221, 439/222, 223, 628

See application file for complete search history.

(56) References Cited

U.S. PATENT DOCUMENTS

| | | | | |
|---|---|---|---|---|
| 4,626,052 | A * | 12/1986 | Rumble | 439/173 |
| 6,227,883 | B1 * | 5/2001 | Lee et al. | 439/106 |
| 6,328,581 | B1 * | 12/2001 | Lee et al. | 439/106 |
| 7,223,126 | B2 * | 5/2007 | Ng | 439/651 |
| 7,381,067 | B2 * | 6/2008 | Sze | 439/131 |
| 7,445,513 | B1 * | 11/2008 | Lee | 439/652 |
| 8,033,867 | B1 * | 10/2011 | Kessler et al. | 439/652 |
| 2006/0148291 | A1 * | 7/2006 | Bona et al. | 439/172 |

FOREIGN PATENT DOCUMENTS

| | | |
|---|---|---|
| DE | 88 06 144 U1 | 7/1988 |
| DE | 198 45 962 | 10/1999 |
| DE | 200 14 987 | 10/2000 |
| EP | 0 156 076 A | 10/1985 |
| EP | 0 616 389 | 9/1994 |
| EP | 1 257 018 | 5/2002 |
| GB | 2 366 087 | 2/2002 |
| WO | WO 02/063722 | 8/2002 |
| WO | WO 02/063723 | 8/2002 |
| WO | WO 2007-015156 | 2/2007 |

* cited by examiner

*Primary Examiner* — Edwin A. Leon

*Assistant Examiner* — Harshad Patel

(74) *Attorney, Agent, or Firm* — Morriss O'Bryant Compagni, PC

(57) ABSTRACT

The invention relates to an adapter set (11). The adapter set is made up of a plug part (13) and a socket part (15). The plug part (13) is provided with at least one three-pole plug contact (20,30,40,50) of a particular country standard at one end and a three pole safety plug socket (17) at the other end of the adapter set (11). The socket part (15) is provided with a three-pole safety plug (19) and a three-pole multi-way plug socket (16). The adapter set (11) comprises one single safety plug (19), namely the plug formed on the socket part (15). It is provided that the polarity of the multi-way plug socket matches the polarity of the plug contacts.

30 Claims, 11 Drawing Sheets

THREE-POLE ADAPTER SET WITH A PLUG PART AND A SOCKET PART WHICH MAY BE PLUGGED IN THE PLUG PART

CROSS-REFERENCE TO RELATED APPLICATIONS

This application claims priority to PCT Patent Application No. PCT/CH2009/000204 filed on Jun. 16, 2009 and Swiss Patent Application No. 923/08 filed on Jun. 17, 2008, the entirety of each of which is incorporated by this reference.

FIELD OF THE INVENTION

The invention relates to an adapter set with a plug part and a three-pole multi-way mains plug comprising three-pole plug contacts, which is equipped with pins of different mains plug standards and a plug socket, and a plug for plugging into the plug socket.

STATE OF THE ART

A two-pole multi-way mains plug with pins which can be pushed out is known from WO 02/063722. The latter in each case has, in a housing, two contact pins of a Euro plug contact with a Euro plug-in body which can be pushed out, a US plug contact, an AU plug contact and a UK plug contact with an opener. This known mains plug is provided with a plug socket, in which a plug socket part with a multi-way plug socket can be plugged. The plug socket part has plug-in receptacles for the two pins of a Euro plug, a US plug, an AU plug and three plug-in receptacles for the pins and the opener of a UK plug. The plug socket part is equipped with special pins, which cannot be plugged into any standard plug socket, but only into the plug socket of the multi-way mains plug.

The two part nature of the set allows the set to be supplemented by a voltage converter or another additional apparatus, which voltage converter can be plugged into the plug socket of the multi-way mains plug and to a large extent has space within the cavity of the plug socket, and which, under some circumstances, is equipped with a plug socket for the socket part.

As the cavity of the plug socket is too small to ensure covering according to specifications of a safety plug, this specification proposes that it be made possible to insert into the plug socket of the multi-way mains plug a safety plug collar which guarantees the covering, specified by the German standard, of a safety plug inserted into this plug socket. As a safety plug may not be plugged into a two-pole plug socket, and is therefore equipped with pins which are too thick for two-pole plug sockets, this suggestion does not achieve the goal.

The drawback in the subject matter described is that the set can only produce a transition from two-pole sockets to two-pole plugs.

A three-pole adapter is known from the German patent No. 198 45 962 C1. This has plug contacts, which are arranged in a star shape, of different standards with three pins, in each case, and one safety plug socket in the centre of the star. By rotating a contact part, one plug contact after the other is actuated in turn, it only being possible to activate a single plug contact in each case. A development of this adapter is known from EP-A 1 257 018. In the latter, the plug socket itself is rotatably arranged to activate the plug contact of a particular standard. The commercially available version of this development has, in contrast to the version shown in the patent mentioned, no hybrid safety plug, but a plug exclusively of a French standard, which cannot be plugged into a safety socket of a German standard.

The drawback in these adapters is that they are only suitable for plugging in safety plugs and two-pole Euro plugs. The plugs, for example, of a US standard, an AU standard, a UK standard, a CH standard or an IT standard cannot be plugged in.

An adapter is known from GB-A 2 366 087, which is configured on an end face in such a way that a large number of different end panels with plug contacts of a different standard can be arranged thereon. The rear of the adapter is designed to arrange a large number of different sockets thereon. Various standards of plug contacts can thus be combined with various standards of sockets. As a result, the adapter desired for the specific situation can be assembled from a set of parts. An exemplary embodiment shows an adapter of the type with a safety plug and a multi-way plug socket for the standards of the UK, US, AU, IT and other territories. The drawback in this adapter is that the front panel can be removed from the adapter and can be plugged without protection into a plug socket, whereupon current-carrying parts are bare and accessible. Presumably for this reason, this plug is not available as a kit, but only as an individual adapter, the front panel of which cannot be changed. The drawback in the commercially available adapter is that it can only now be plugged with the hybrid safety plug in safety plug sockets of the German standard and plug sockets of the French standard.

It is therefore an advantage of the invention to provide an adapter conforming with standards, which connects between most three-pole plug sockets, including the safety socket, and most three-pole plugs, including the safety plug. This adapter is moreover to have a small overall size.

SUMMARY OF THE INVENTION

According to the invention, an adapter in which, of the various available plug contacts, the safety plug is exclusively formed on the socket part and the safety plug socket is exclusively formed on the plug part. This arrangement has the great advantage that an adapter set of this type can be very compactly constructed as both the safety plug socket and the safety plug are, in each case, only present once on the adapter set. This has the advantage that the plug contacts of the plug part do not have to have a safety plug, as the safety plug is already present in the separate socket part. If a safety plug is required, only the socket part is therefore used. The socket part—as can be seen from the figures—can be configured as a very compact attachment, as the bulky safety plug has a great deal of space to receive the plug contacts of various other standards in the interior. The compact mode of construction of the adapter set is therefore achieved in other words in that, the three-pole plug contacts of the plug part may correspond to one or more different plug standards but do not contain a safety plug, and different plug standards are formed or are present on the socket part—but no safety plug socket, and in that the socket part can be connected to the plug part by means of a safety plug socket formed on the plug part and a safety plug formed on the socket part. The safety plug and safety plug socket may in this case contain both the German and the French safety plug standard. In the adapter set according to the invention, only a single plug is therefore present, which is compatible with safety plug sockets or plug sockets of the French standard, and which is configured as a hybrid safety plug on the socket part.

The adapter set according to the invention therefore has in common with the prior art according to WO 02/063722 that it is two-part, and is therefore an adapter set which is formed from a plug part with a plug socket and a plug, which fits this plug socket, with a multi-way plug socket. It has in common with the prior art according to DE 198 45 962 C1, that the multi-way plug is equipped with three-pole plug contacts and has a safety socket. It has in common with the prior art according to GB 2 366 087 that the multi-way plug socket has a hybrid safety plug.

Beyond the teachings of this prior art, the invention, however, teaches that a set is to be formed from a (multi-way) plug of this type, which does not have a safety plug or a plug of a French standard, and a multi-way plug socket of this type with a hybrid safety plug. This set formation allows, in contrast to the cited prior art, this adapter plug to be produced with a small overall size, because no safety plug is formed on the plug part. The safety plug of the socket part is hybrid for compatibility with the safety plug sockets of the German standard and plug sockets of the French standard. This means that a safety plug does not have to be formed on the plug part nor does a safety socket have to be formed on the socket part, and yet with the aid of this set, the most varied mains plugs, including safety plugs, can be inserted in the most varied sockets, including safety sockets. The safety socket and the safety plug are in addition, arranged in a very space-saving and invisible manner despite their size and their striking appearance, when the set components are in the assembled state.

It is advantageous to take at least one precautionary measure in the adapter set, so the hybrid safety plug can only be plugged in one position into the safety plug socket. Correct polarisation of the plug receptacles and plug contacts with pins arranged in the triangle can thus be achieved.

If a star-shaped arrangement of the different plugs is also possible, so the pins project approximately radially from the plug housing, it is desirable that the plug contacts of different standards are displaceably mounted relative to the housing of the plug part. All the pins are expediently displaceably mounted parallel to one another. They can be pushed into a passive position into the housing and pushed out from the housing into an active position. This has the known effect that the plug part has a small overall size, because the plug contacts can be arranged nested in one another thanks to this displaceability. The displaceability in each case allows the pins of a plug contact of a standard to be pushed forward, while the pins of the other plug contacts lie within the housing.

A CH plug contact with a CH plug-in body is provided, which CH plug-in body can be pushed into the housing and pushed out from this housing, and the pins of the CH plug contact can be pushed along a displacement path into the CH plug-in body into a passive position and pushed out from the CH plug-in body into an active position. The CH plug contact, because of the displacement path for the plug-in body and the displacement path for the pins, has a particularly long displacement path. This is longer than in the other plugs. It would be just as long for a displaceable safety plug. However, one of these is not provided according to the invention. Rather, a safety plug is formed on the plug socket part, which safety plug can be plugged in a safety plug socket in the plug part. This safety plug socket requires a relatively large depth, which extends in the same direction as the displacement path of the CH plug contact.

The displacement path of the CH plug contact therefore advantageously extends to next to the safety plug socket. This overlap of displacement path of the CH plug contact and the plug-in depth of the safety socket is the reason for the surprisingly small dimension of the plug set in the displacement direction.

A further contribution to the shortness of the plug set in the direction of the displacement paths is provided by the arrangement of all the plug receptacles of the multi-way plug socket within the safety plug-in body. Thanks to the size of the plug-in body of the safety plug contact, it is possible to receive the plug sockets for the pins of plugs of different standards.

The safety socket, apart from the peripheral ground contacts according to the German standard, may be configured with a ground pin of the French standard. The FR ground pin is advantageous, in particular for the inner structure of the plug part, as will be shown below. The safety socket may be configured with or without the FR ground pin. A short, non-projecting pin or a long, projecting pin merely has to be inserted in the plug part in order to produce these two sets to be supplied differently for Germany and France.

In certain countries, care has to be taken about the correct polarisation in three-pole plugs. In the plug socket of the French standard, the polarisation is given. The safety plug of the German standard is meanwhile not defined with regard to its polarisation. Without suitable measure, in a safety plug of the German standard, all the plug-in receptacles present in the socket part are undefined with regard to their polarisation, although the plug contacts (all except IT and safety) are defined with respect to their polarisation. So that the polarisation between plug contacts of the plug part and plug-in receptacles of the socket part cannot be confused, either, in the adapter set with the safety socket of the German standard, a protrusion is formed on the plug part and a recess receiving the protrusion is formed on the socket part, so the socket part can only be plugged in in one position into the plug part. However, this cannot prevent the safety plug contact of the socket part being plugged into a safety socket wrongly with regard to the polarisation. Apparatuses with safety plugs may also not in any way be sensitive with regard to the polarity. However, in the case of standards with unambiguous polarisation, the plug can therefore not be plugged in incorrectly polarised.

The prerequisite for the continuously correct polarisation is that the plug contacts defined with regard to polarisation, which all have a triangle pin arrangement with the ground pin on a plane of symmetry, are correspondingly correctly connected. It is advantageous for a simple contact guidance in the interior of the housing that the pins for the phase are in each case arranged on the same side of this plane of symmetry. If therefore a UK plug contact, a US plug contact and an AU plug contact are provided with a common plane of symmetry through the ground pins, the ground pin in the AU plug contact and in the UK plug contact is in each case arranged on the same side, but, in the US plug contact, in comparison to this, it is arranged on the other side of its pins for phase and neutral conductor.

If an FR ground pin is present in the safety socket of the plug part, the polarisation is maintained if it is located in the common plane of symmetry and, with regard to the two receptacles for phase and neutral conductor, on the same side as the ground pin of the US plug contact is located with regard to its pins for phase and neutral conductor.

Overall, care is taken that each plug standard present is configured on the plug part and on the plug socket part in such a way that the plug-in receptacles in the socket part are arranged the same with regard to the orientation of phase, neutral conductor and ground as the corresponding pins of the plug contacts of this standard on the plug side.

The FR ground pin can also only be present within the housing, and be missing outside the housing. The part within the housing namely advantageously forms a sliding bearing. This allows the establishing of a sliding contact between the ground pin of a plug contact which can be pushed out and the sliding bearing, which is formed by the ground pin. The sliding bearing can also be configured independently of the ground pin of the FR socket. However, it is advantageously formed on an extension of the ground pin of the FR socket, which extends through the housing. This configuration of the FR ground pin is used for its stabilisation and simultaneously grounding of an extendable ground pin of a plug contact of another standard.

The subject matter of the present invention is also a socket part in which at least two, at least three or at least four different plug sockets are formed on the socket panel. This socket part has the advantage that it can be economically produced and allows three-pole plugs of a plurality of country standards to be equally received. The plug socket part advantageously has at least three plug sockets or at least four plug sockets of the country standards CH, IT, UK, US and AU. In combination with an adapter plug, which has a plug of any country's standard (apart from a safety plug) and a safety plug socket, the socket part can provide the plug sockets of the economically most significant countries of the world.

According to one embodiment, the ground contacts are arranged in a common plane and the phase pins and neutral conductor pins are arranged symmetrically thereto. This has the advantage that the plug part can be constructed with a minimum number of different parts. A common plug-in opening is expediently provided in the socket panel for the ground pins of the CH, IT, US and AU standard. This has the advantage that the socket part can be particularly compact.

According to another aspect of the invention, the plug socket part may have at least any two plug sockets of the country standards Israel (IL), India (IN) or Denmark (DK). All three aforementioned country standards are implemented in a single socket part. Since the plug sockets are housed in the safety plug housing, the socket part is relatively small and compact.

In order to stabilise the FR ground pin, this sliding bearing pin is fixed both at the front in the housing of the plug part and also at the rear in the base of the safety socket.

BRIEF DESCRIPTION OF THE DRAWINGS

The invention will now be described in detail with the aid of the figures, in which.

DETAILED DESCRIPTION OF THE ILLUSTRATED EMBODIMENTS

Figure 1:
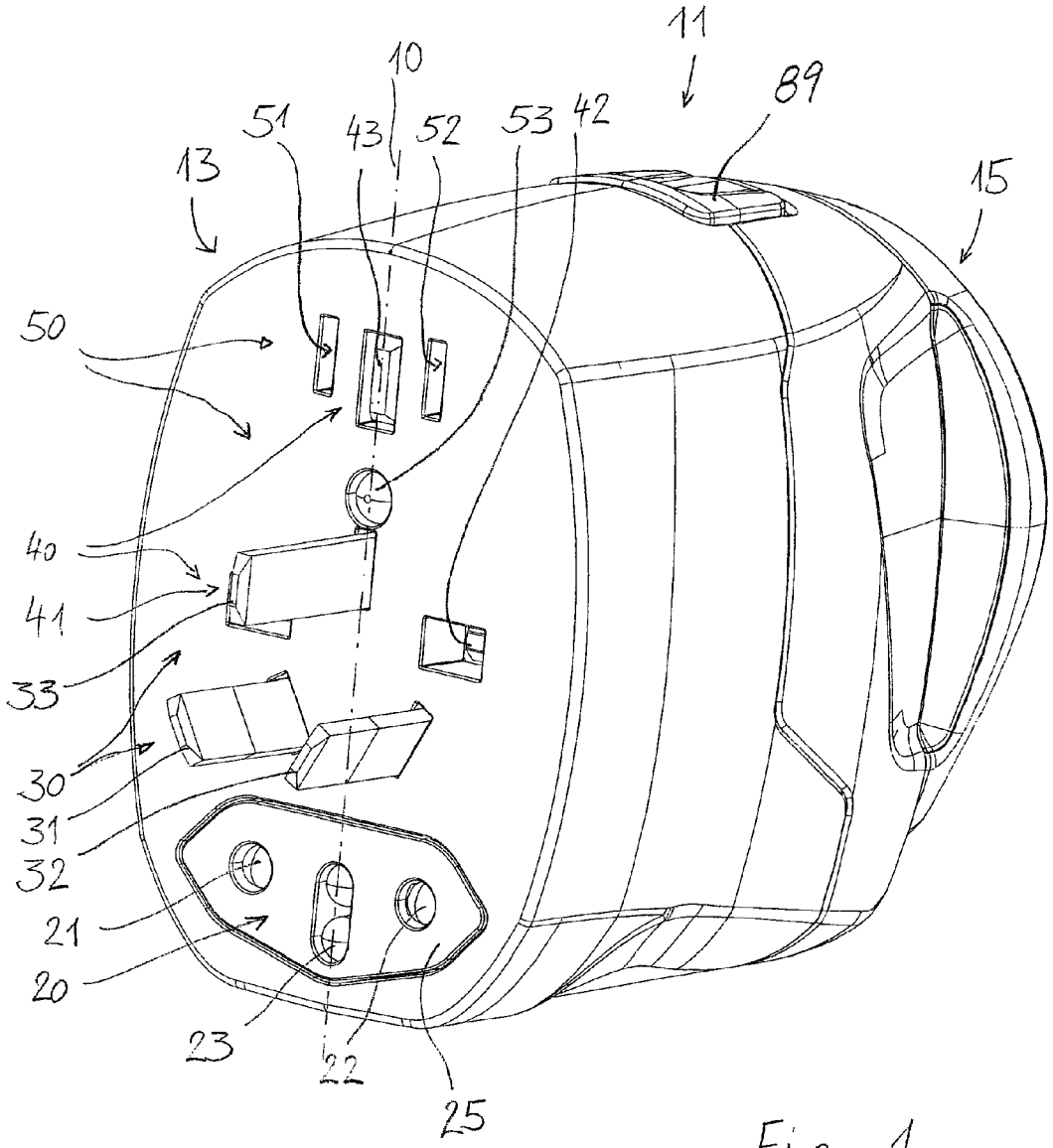
FIG. 1 shows an assembled adapter set according to the invention, with a plug part with a pushed out AU plug contact and a first exemplary embodiment of a socket part.
Figure 2:
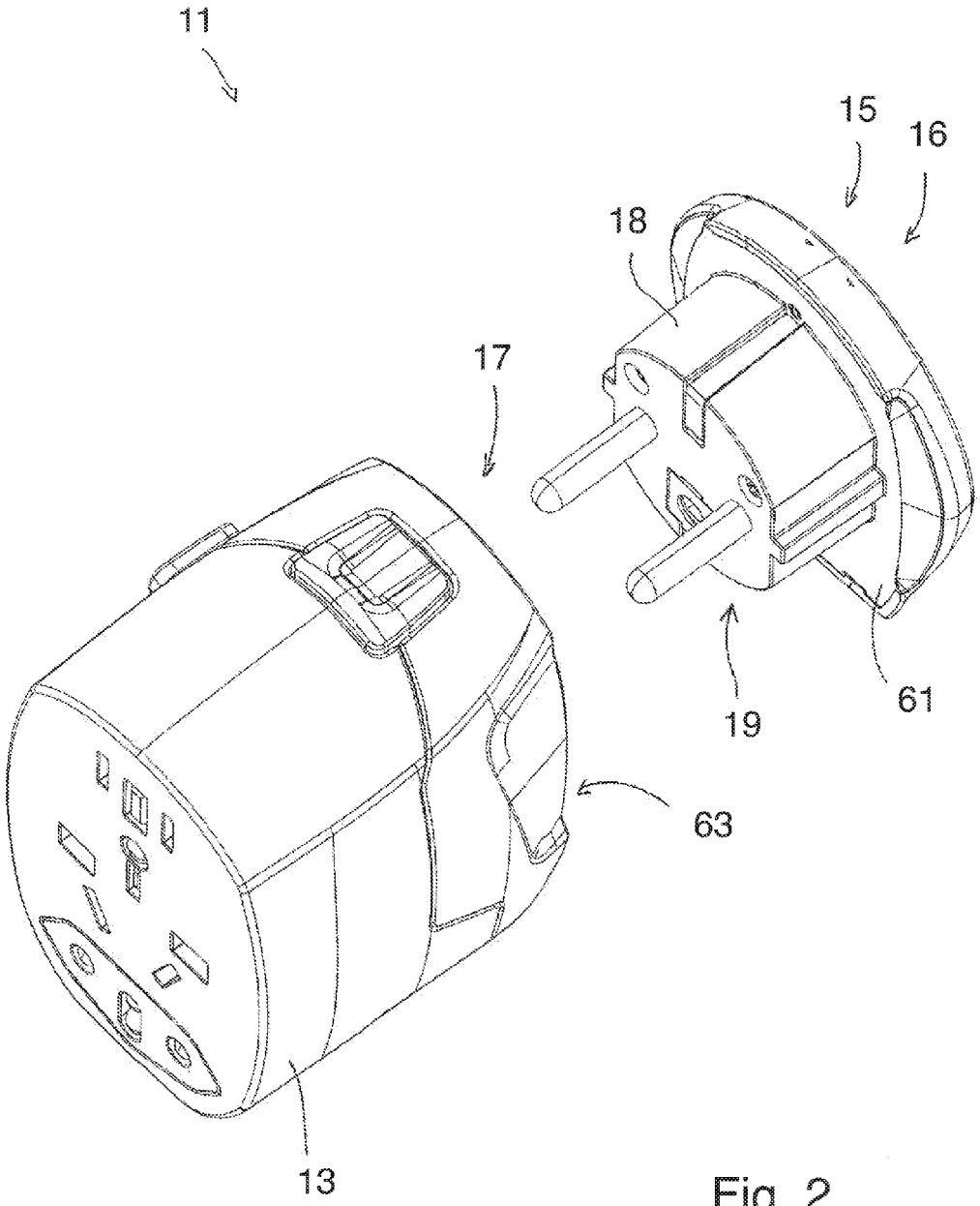
FIG. 2 shows an adapter set, in which the plug part and socket part are released from one another, with a view of the hybrid safety plug of the socket part.
Figure 3:
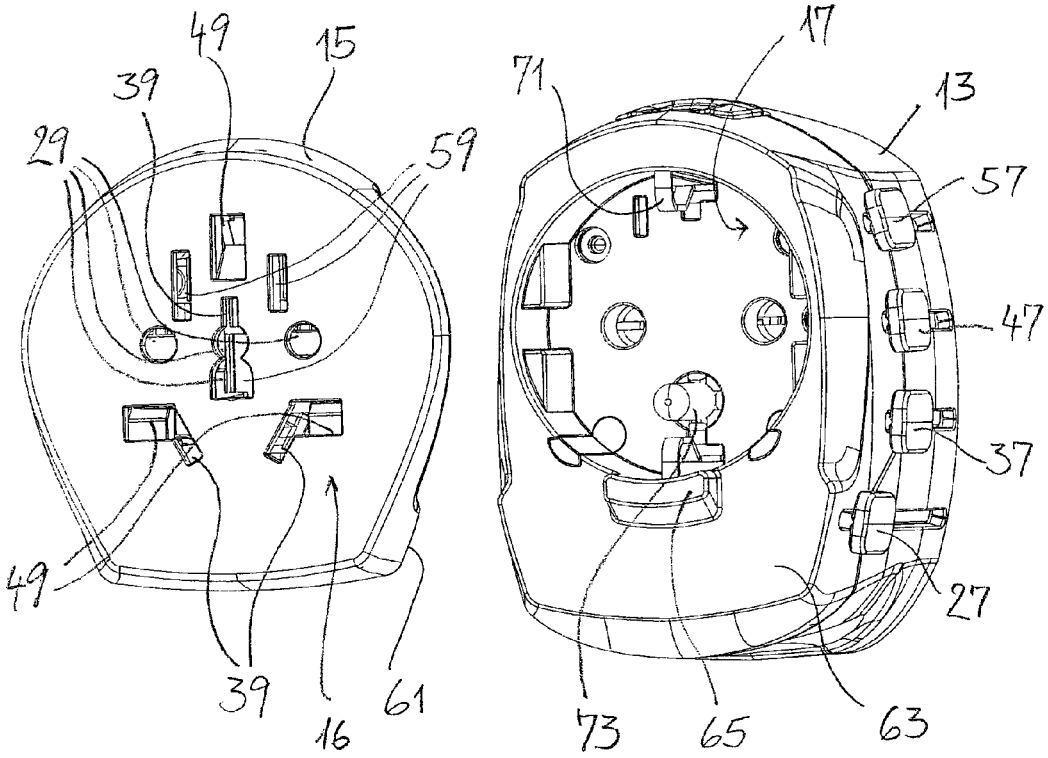
FIG. 3 shows the adapter set according to FIG. 2 with a view into the safety socket of the plug part and a plan view of the socket part.
Figure 4:
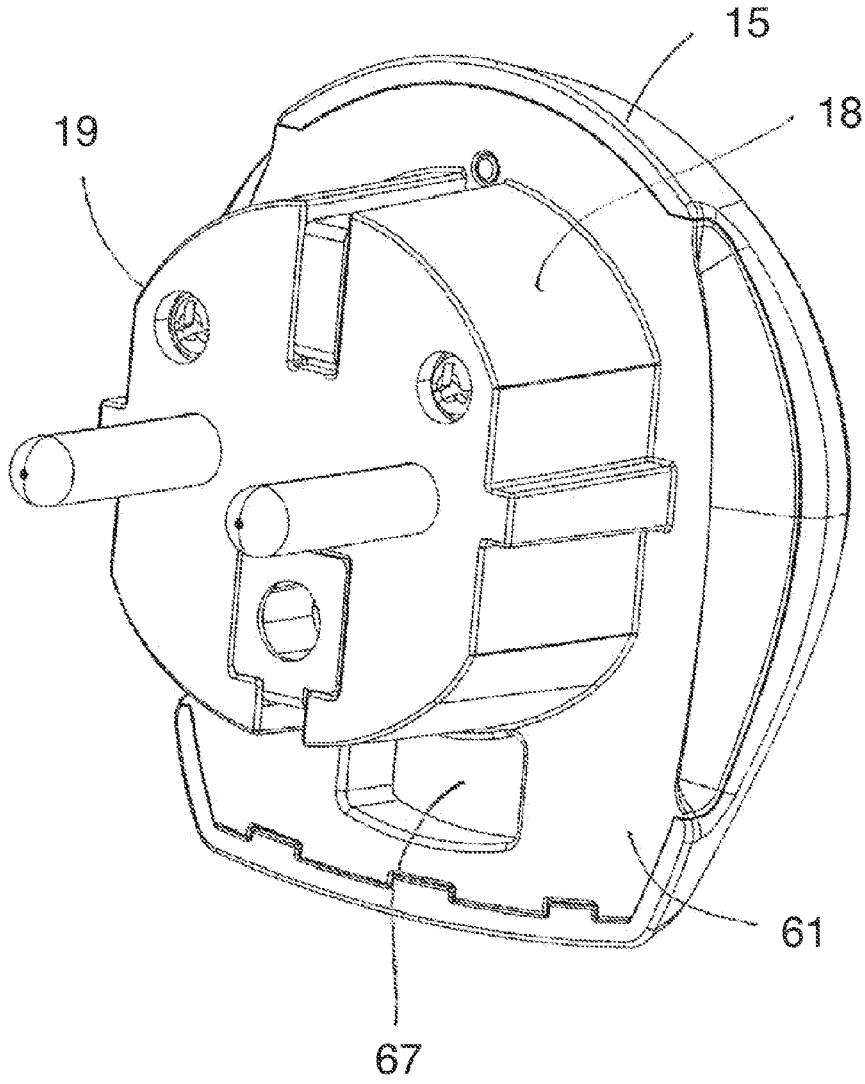
FIG. 4 shows a perspective view of the safety plug with a recess for the safely correct polarisation.

The adapter plug set 11 in FIG. 1 has three-pole plug contacts in a plug part 13 and three-pole plug receptacles in a plug socket part 15. The plug receptacles together form a multi-way plug socket 16 (FIG. 3). The pins of the plug contacts and clamps of the plug receptacles are arranged symmetrically with respect to a plane 10 of symmetry through the ground pins and ground terminals. The plug contacts 20 (CH/IT), 30 (AU), 40 (UK), 50 (US) can be displaced between a passive position, in which the plug contacts 20 are pushed into the housing of the plug part 13, and an active position, in which the plug contacts 20 project out of the housing. The displacement from the passive into the active position and back takes place by actuating buttons 27, 37, 47, 57, which are visible in FIG. 3. The plug contacts 20, 30, 40, 50 are arranged polarised in conformity with the standards. The polarisation can only not be unambiguously established in the CH/IT plug contact 20 with the ground pin in the position for Italy. In FIG. 1, the phase pins 21, 31, 41, 51 are arranged on the left-hand side, the neutral conductor pins 22, 32, 42, 52 on the right-hand side of the figure and the ground pins 23, 33, 43, 53 are arranged in between on the plane of symmetry.

The CH/IT plug contact 20 has a plug-in body 25 which can be pushed out. In this plug-in body 25, the pins 21, 22, 23 are displaceably mounted. They can therefore be pushed out into the active position and pushed into the passive position shown, the plug-in body 25 also being moved out from the housing in the active position by the length specified by the standard. The pins of the CH/IT plug contact which are displaceable in the plug-in body 25 are in this case pushed further out of the plug-in body by their pin length in the active position. The CH/IT ground pin 23, in the active position, can be pushed into an IT-conforming position (on a line with the pins 21 and 22) or into a CH-conforming position (triangle arrangement). This displacement of the ground pin 23 in the active position takes place perpendicular to the displacement direction of the plug contact. The ground pin 23 is displaced manually.

A safety socket 17 (visible in FIG. 3), in which the socket part 15 can be plugged, is now formed in this adapter set 11 in the plug part 13, according to the invention. The socket part 15 for this purpose has a hybrid safety plug 19. Hybrid means that the safety plug 19 can be plugged into safety sockets of the French standard and also of the German standard. The hybrid safety plug 19 is configured conventionally. Following the plug-in body 18 of the safety plug 19 is a collar 61, which can rest on the rear 63 of the plug part 13.

The safety socket 17 is configured with an ground contact 71 according to the German standard and with an ground pin 73 according to the French standard. However, in particular for use in Germany, where non-hybrid safety plugs are frequently present, the ground pin 73 may be missing. The safety plug 19 of the socket part 15 fits into the safety socket 17 in both cases.

On the socket side of the socket part 15 opposing the safety plug, plug receptacles 29, 39, 49 and 59 are present for the plug standard corresponding to the plug contacts 20, 30, 40, 50 of the plug part 13. These plug receptacles together from a multi-way plug socket 16. The socket side has a plurality of plug-in holes, which correspond to the plug contacts of different country standards. Arranged behind the holes are metal terminals, in which the plug contacts can be plugged. The terminal for the CH ground pin in this case is the same as for the US ground pin. The plug-in holes in the housing for the ground pins of the Italian, Swiss, US and Australian standard are connected. The plug-in holes for the phase and neutral conductor pins of the UK and AU plugs are also connected.

So that the polarisation of the unambiguously polarised plug contacts 20, 30, 40, 50 and plug receptacles 29, 39, 49, 59 coincide, they are oriented in the same direction. If in UK and AU plugs or receptacles the ground contact points are above the other two pins or receptacles, in the CH and US plugs and receptacles, these ground contact positions are located under the other two pins or receptacles.

If the safety plug 19 on the socket part 15 and the safety socket 17 on the plug part 13 are both hybrid, the connection with the correct pole between the plug contacts and plug socket is certain. However, if the safety socket 17 on the plug part 13 does not have an ground pin 73, a safety plug can be plugged in in two positions. In order to prevent this in the safety plug 19 on the socket part 15, a protrusion 65 is formed on the rear 63 of the plug part 13. This protrusion 65 cooperates with a recess 67 on the collar 61 of the socket part 15 when the socket part 15 is placed in the correct orientation. If the socket part 15 is rotated through 180°, it cannot be plugged into the safety socket. As a result, the socket part 15 can only be plugged into the plug part 13 in one position, in which the contours of the plug part and of the socket part fit together. Safety plugs of electrical apparatuses may, however, be plugged in any orientation into the safety socket 17 on the plug part 15.

Figure 5:
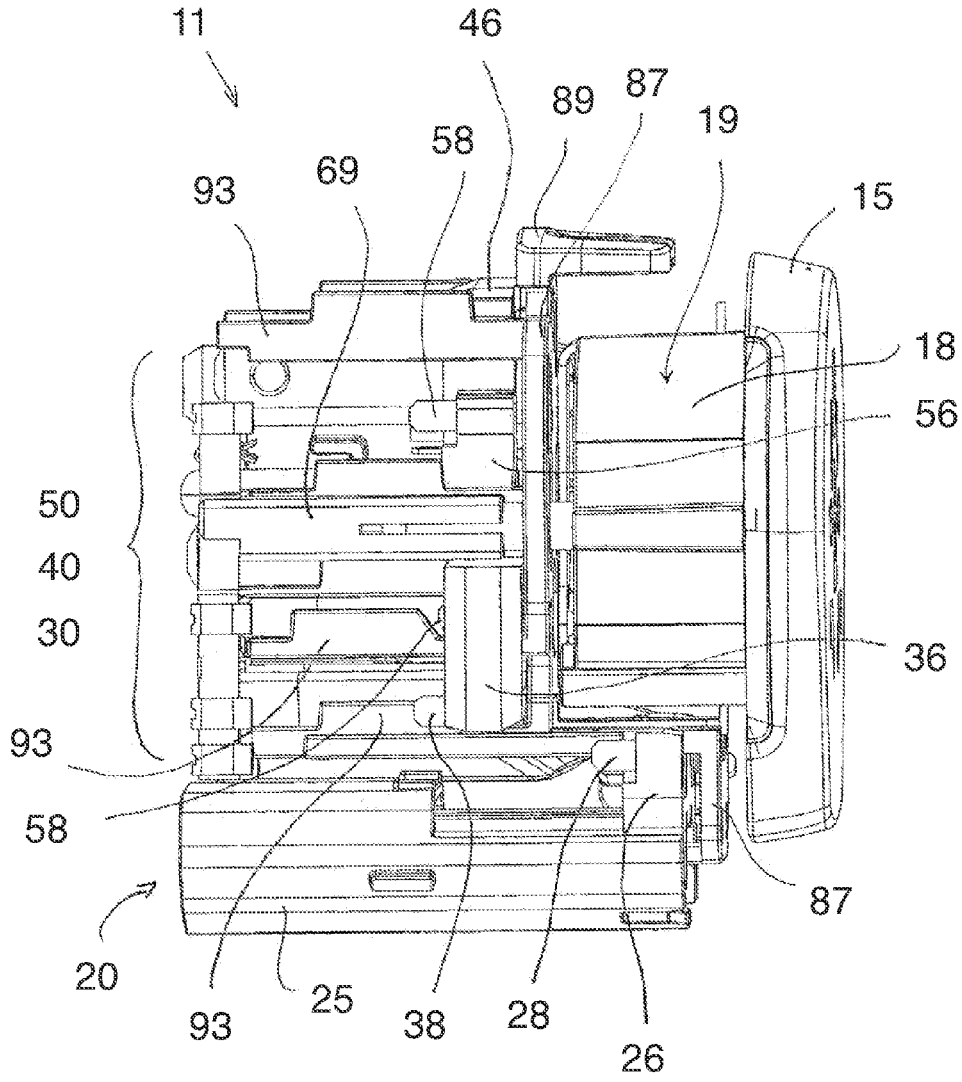
FIG. 5 shows an assembled set without a housing of the plug part.

FIG. 5 shows the adapter set 11 without the housing of the plug part 13. As a result, the displacement parts of the plug contacts 20, 30, 40, 50 are visible. The socket part 15 is plugged into the plug part 13. It can be seen that the safety socket 17, which comprises the plug-in body 18 of the safety plug 19, and the displacement region for the CH/IT plug 20 are arranged next to one another. The rear region of the plug-in body 25 and the slides 26 of the pins 21, 22, 23 of this plug contact 20 are arranged laterally next to the socket 17.

When the slide 26 is pushed forward by means of the actuating lever 27 (FIG. 3) the latter pushes on a stop edge of the plug-in body 25 and also pushes it into the active position. When being pulled back, the slide 26 pushes on a rear entraining lug (not visible in the figures) and pulls the plug-in body into the passive position.

In the active position, minipins 28 are plugged into three contact strips 81, 82, 83. These minipins 28 are in conductive contact with a respective pin 21, 22, 23 of the plug contact 20. The contact strip 81 is in contact with terminals 69 for the pins of the safety plug 19.

The other plug contacts 30, 40 and 50 need a smaller displacement path and are arranged in front of the safety socket 17 in the sliding direction. The terminal 69 for the contact with the pins of the safety plug 19 are arranged between the pins of these plug contacts. These other plug contacts 30, 40, 50 also plug into the contact strips 81, 82, 83 in the active position with minipins 38, 48, 58.

The ground pin 33 of the AU plug contact 30 is an exception. The latter slides with a consumer 35 over a pin 75. This pin 75 is in conductive contact with the ground contact strip 83 and is, if present, the extension of the FR ground pin 73.

Figure 6:
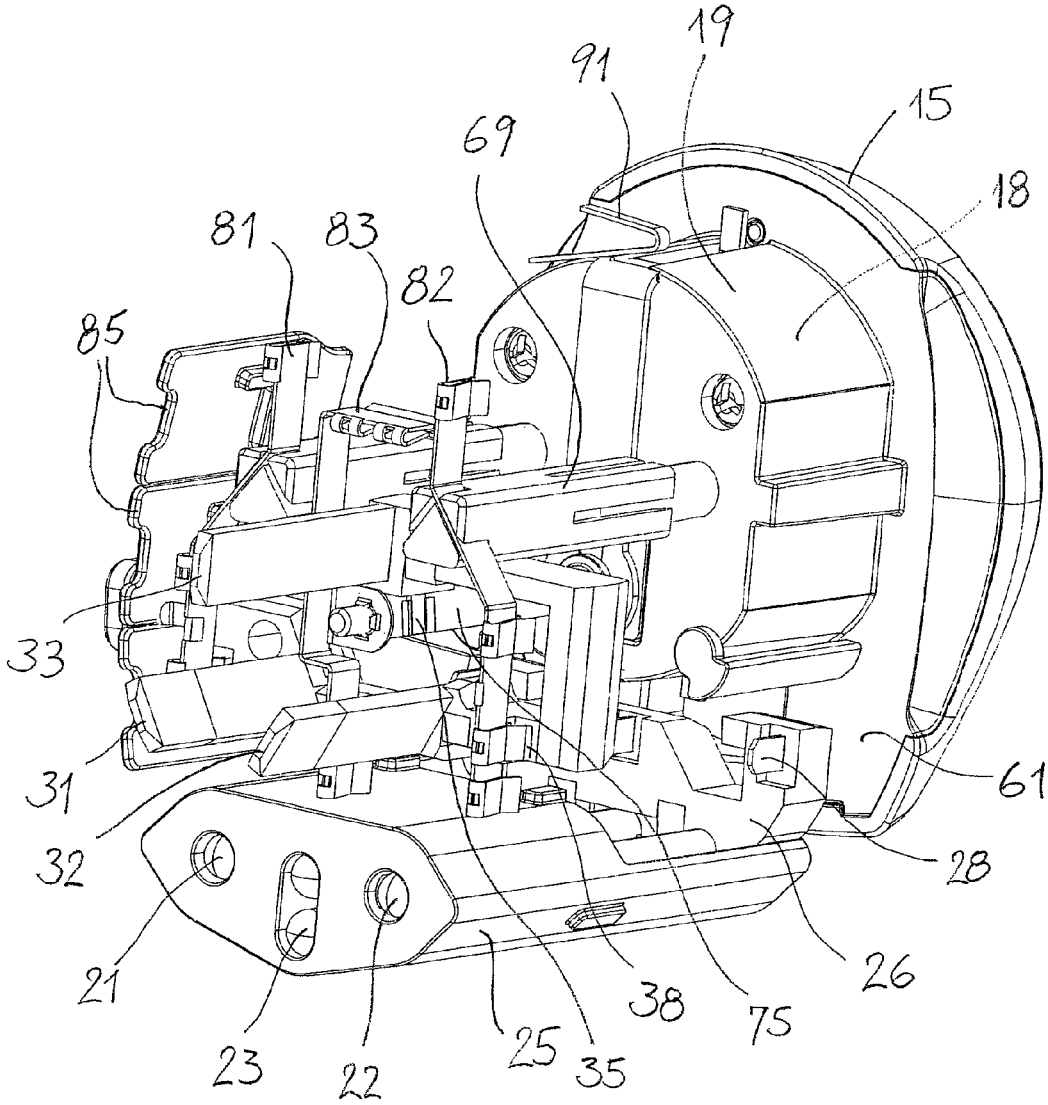
FIG. 6 shows an assembled set according to FIG. 5 after additional removal of some sliding plug contacts and a locking part and an AU plug contact in the active position.

FIG. 6 shows the AU plug contact 30 in the active position. The plug contacts 40 and 50 are removed from the view so the latter is clearer. The AU plug contact is in the passive position in FIG. 7. The consumer 35 is right at the back on the pin 75.

Figure 7:
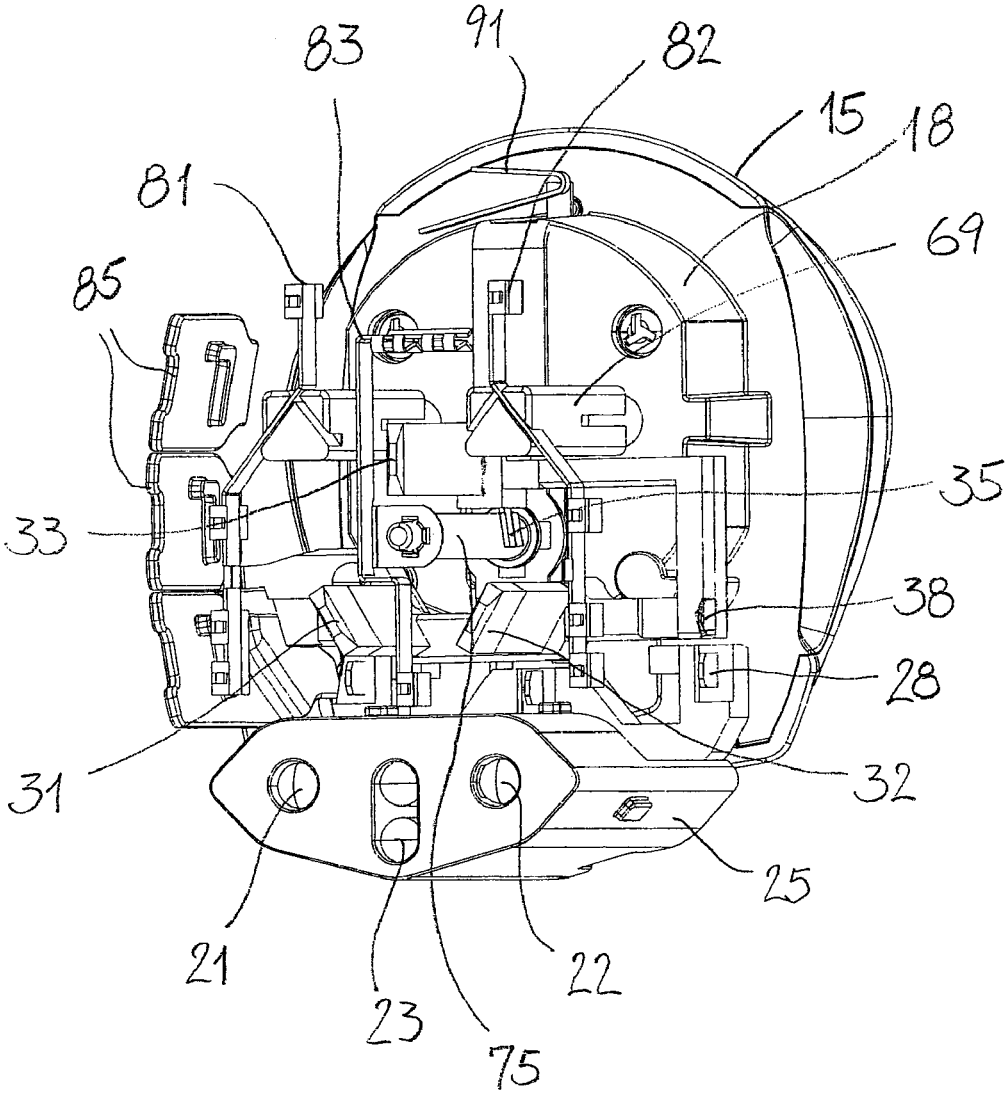
FIG. 7 shows a set according to FIG. 6 with an AU plug contact in the passive position.
Figure 8:
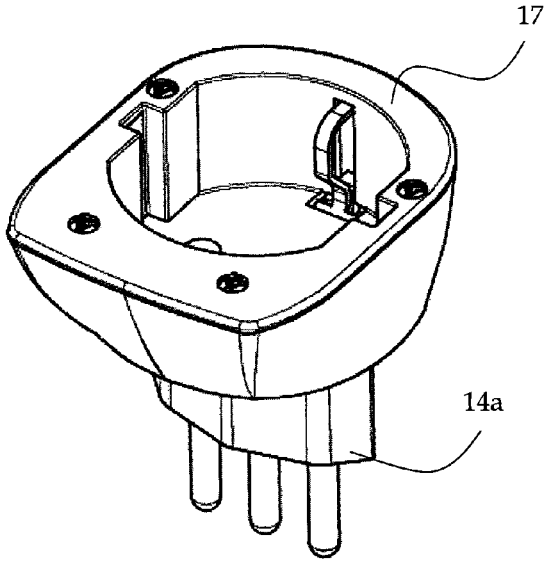
FIG. 8 shows a first example of a plug part with a plug of the Swiss (CH) standard and a safety socket in a perspective view.
Figure 9:
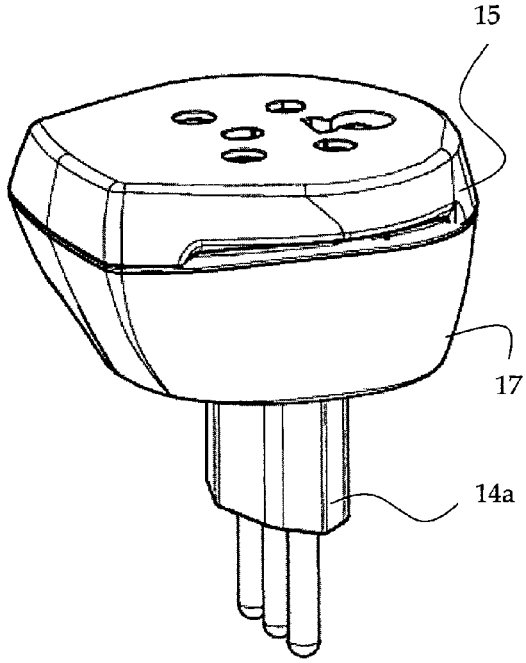
FIG. 9 shows a second example of a plug part with a plug of an Italian (IT) standard and a safety socket in a perspective view.
Figure 10:
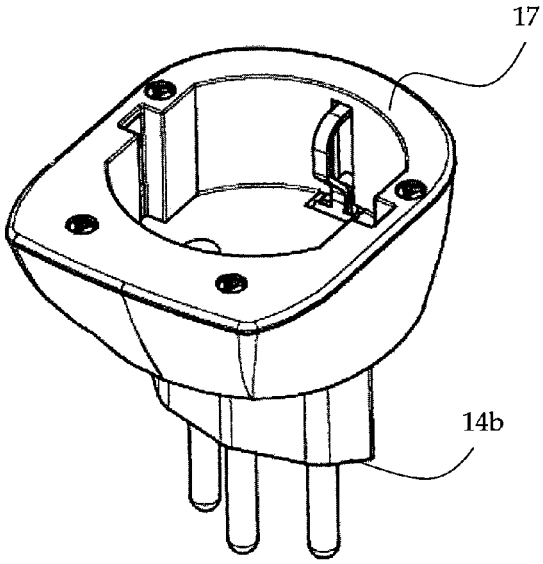
FIG. 10 shows the plug part of FIG. 9 with a plugged-in socket part in a perspective view.
Figure 11:
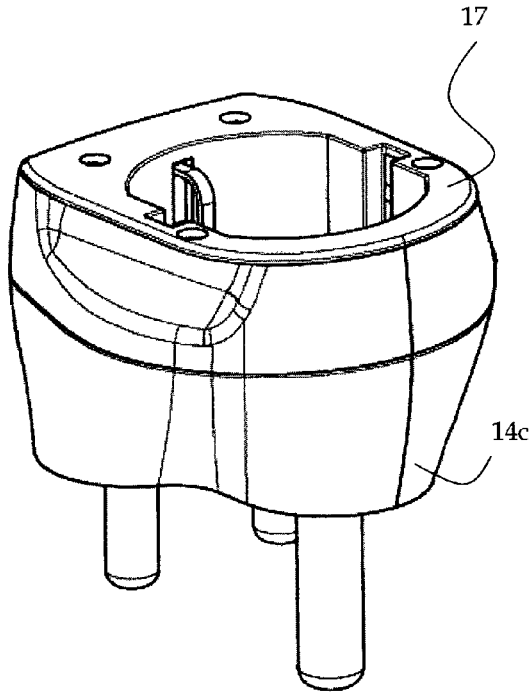
FIG. 11 shows a third example of a plug part with a plug of the African standard and a safety socket in a perspective view.

Shields 85 can be seen in FIGS. 6 and 7. These shields 85 are displaceably mounted in a guide and are in each case pushed to the side by the actuating levers 27, 37, 47 and 57 when these actuating levers 27, 37, 47, 57 are pushed forward into the active position. They then rest without a gap on one another. They thereby prevent a second plug contact being able to be pushed forward into the active position.

A locking part 87 is also shown in FIG. 5. The latter has an actuating button 89 and can be displaced by pressure on the actuating button 89 counter to the spring force of a spring 91 (FIG. 6). The spring 91 is secured in the plug part 13 on the inner housing wall. Owing to the displacement counter to the spring force, arms 93 of the locking part 87 disengage from the slides 26, 36, 46, 56 of the plug contacts. By displacing the locking part 87 by means of the spring force, its arms 93 engage with the slides 26, 36, 46, 56 of the plug contacts and lock these both in the active position and in the passive position.

As can be derived from the thickness of the collar 61, the terminals of the plug-in receptacles in the socket part are all arranged within the plug-in body 18 of the safety plug 19.

The adapter set is composed of a plug part 13 and a socket part 15. The plug part 13 is equipped with three-pole plug contacts 20, 30, 40, 50 of different standards and a three-pole safety plug socket 17. The socket part 15 is equipped with a three-pole safety plug 19 and a three-pole multi-way plug socket 16. The adapter plug set 11 only comprises a single safety plug 19, namely the one formed on the socket part 15. A precautionary measure is taken by means of a ground pin 73 and/or a protrusion 65 on the plug part, which cooperates with a recess 67 on the socket part, which prevents the socket part 15 being able to be plugged into two different positions in the safety plug socket 17.

The adapter set 11 according to the invention may, instead of a multi-way plug, have a plug part 14*a* to *c* with a three-pole plug contact of a first standard and a safety socket 17. As shown in FIGS. 8 to 11, the plug may, for example, be one of a Swiss 14*b*, Italian 14*a*, or African 14*c* or any other country standard with the exception of a safety plug. A safety plug is not required on the plug part as the latter is already formed on the socket part 15. The adapter set with a plug part 13 with a three-pole plug contact of a first standard and a safety socket 17 and a socket part 15 is particularly advantageous for hotels, which receive travellers from different countries. These hotels can, if necessary, leave the travellers an adapter plug, which has a plug 14*a* to 14*c* of the country standard and a safety socket 17, and a socket part 15, which has a safety plug 19 and a plurality of three-pole plug sockets, also including that of the country standard of the traveller. This adapter set allows the hotelier to provide the travellers with the correct plug socket for the electrical apparatuses which they have brought with them.

The socket part 15 according to the invention is distinguished in that it in each case has a plurality of at least three, or at least four, different three-pole plug sockets of different country standards. An adapter set according to the invention may therefore have different plug parts on the plug side, in each case combined with a safety socket 17 and different socket parts 15 on the socket side with three-pole plug sockets of different country standards, in each case combined with a safety plug 19.

Figure 12:
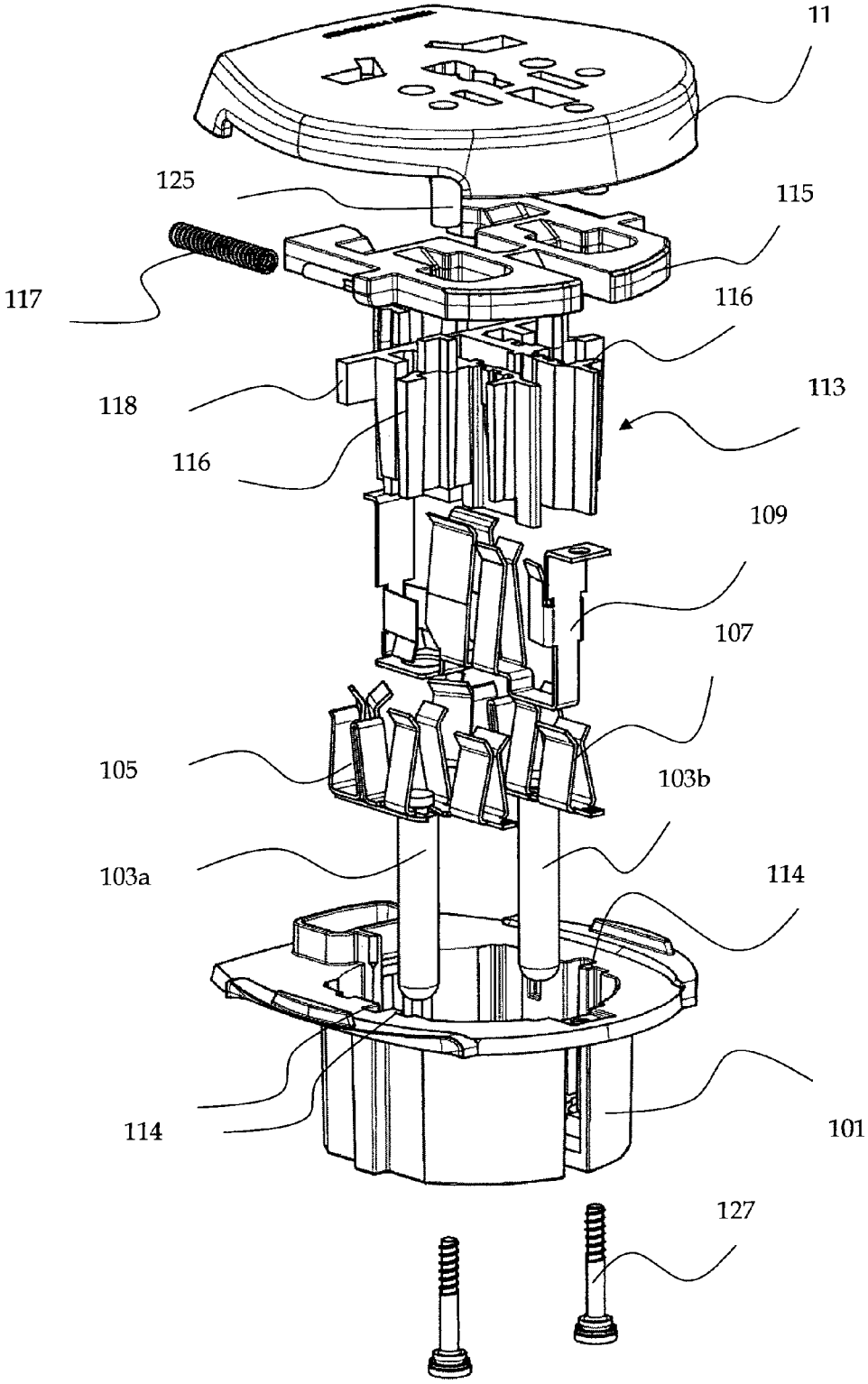
FIG. 12 shows the first exemplary embodiment of a socket part in an exploded view.

According to FIG. 12, the socket parts according to the invention in each case have a safety plug housing 101 with safety plug contacts 103 and, arranged in the safety plug housing 101, a plurality of terminals 105, 107 for receiving the plug pins of plugs of the different country standards. The socket parts 15 may comprises few parts, namely the safety plug housing 101, which has the phase pin 103*a* and the neutral conductor pin 103*b* on the end face, a socket panel 111, which can be placed on the plug housing 101 and in which the plug-in openings 29, 39, 49, 59 are configured for the different plugs of the various country standards, at least three contact parts 105, 107, 109, which form the terminal contacts for receiving the individual pins and can be inserted in the housing 101, and a holding-down device 113 made of plastics material, which can be inserted in the plug housing 101.

A child safety device 115 may also be provided between the socket panel 111 and the holding-down device 113. The child safety device 115 can be displaced on the holding-down device 113 in a specific displacement direction. The child safety device 115 is prestressed by means of a spring 117 supported on the housing wall into a pushed-forward end position, in which the child safety device at least partially blocks the plug-in holes 29, 39, 49, 59 for the phase and neutral conductor pins. This prevents children being able to come into contact with the current-carrying terminal contacts while playing. If the plug pins of a plug are plugged into the plug-in holes, the child safety device is pushed back against the force of the spring 117. For this purpose, oblique sliding faces 120, which come to rest behind the plug-in openings in the rest position, are provided in the panel.

A holding-down device 113 is supported at one end on the end face of the plug housing 101 and, at the other end, on the underneath of the socket panel 111. The holding-down device 113 has arms 116, which can engage in grooves 114 on the inside of the plug housing 101. Projections 118 can engage in corresponding recesses 122 at the upper edge of the housing. As a result, the holding-down device 113 is fixed in position in the housing 101. The holding-down device 113 may, in this case, also have the function of limiting the path of the terminal contacts.

Provided on the underneath of the socket panel 111 are two screw-in sleeves 125, in which two screws 127 can be screwed from the end face of the plug housing in order to fix the socket panel 111 on the plug housing.

Figure 13:
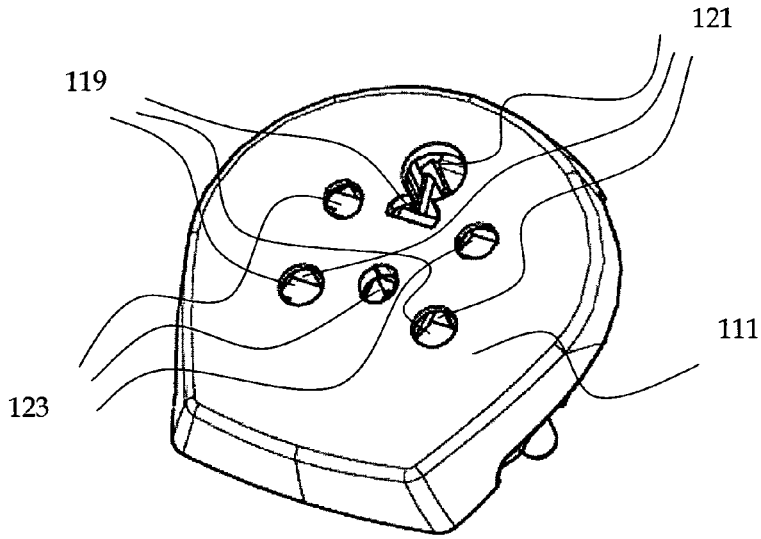
FIGS. 13 and 14 show a second embodiment of a socket part with a plurality of different plug socket standards in two different perspective views.
Figure 14:
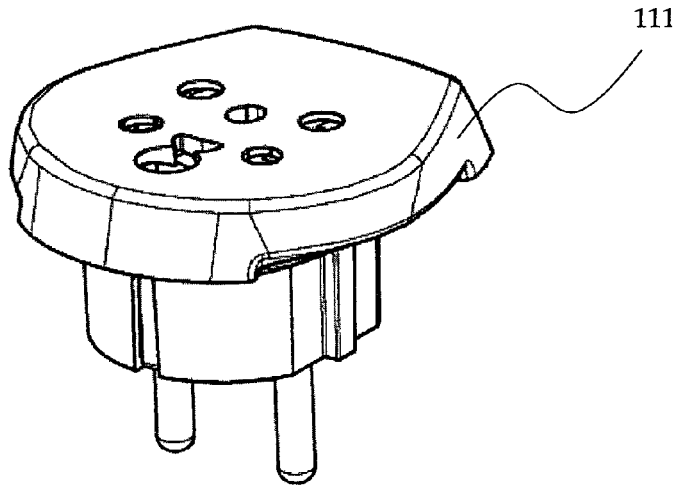
Figure 15:
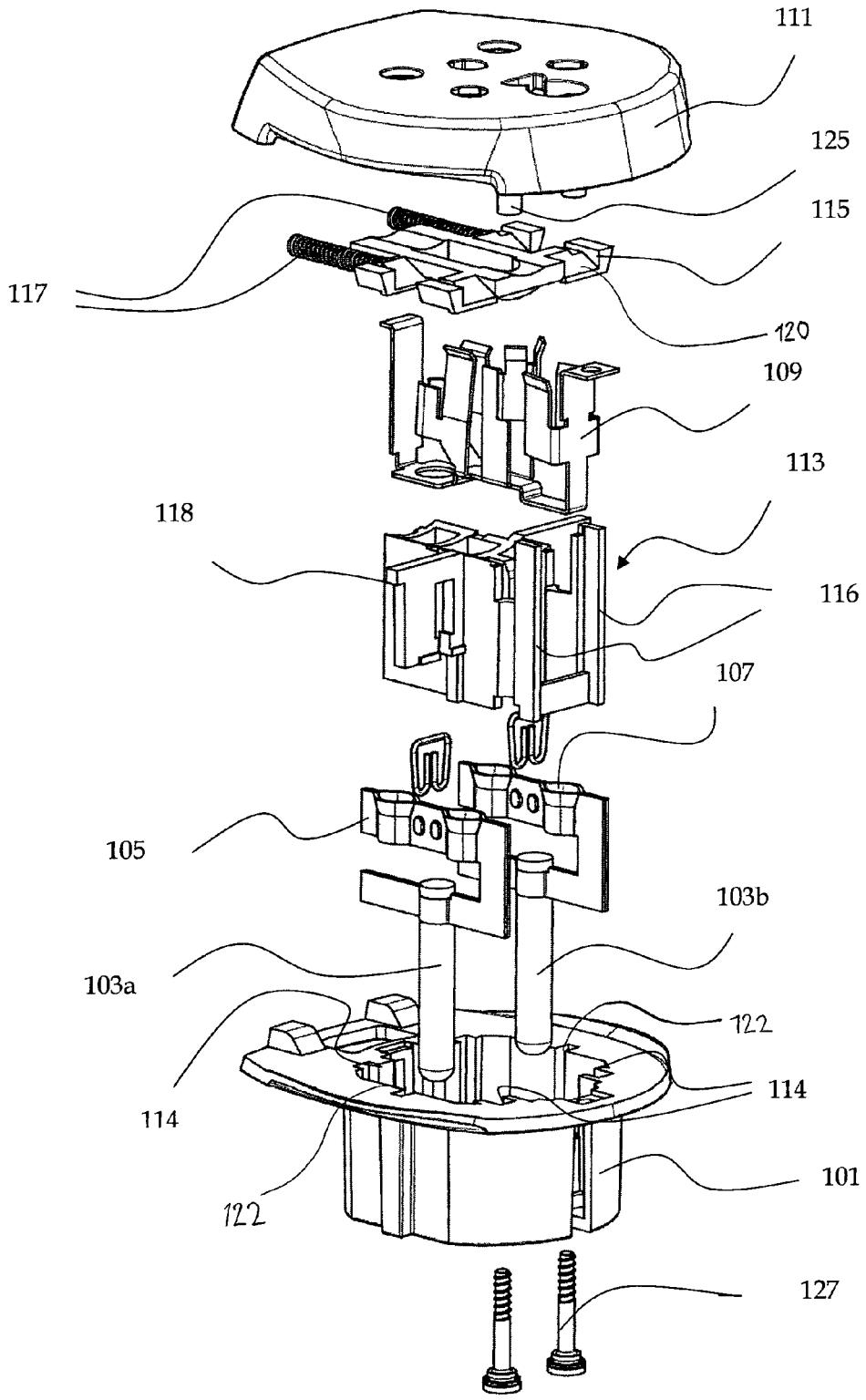
FIG. 15 shows the socket part of FIG. 13, 14 in an exploded view.

The socket parts only have three injection-moulded parts, namely the plug housing, in which the pins are directly inserted or injection-moulded around, the socket panel and the holding-down device. In addition, only three contact elements are present, on which terminal elements to receive the pins of the same type are formed. The phase and neutral conductor pins are, in this case, rigidly connected to the contact elements and can be inserted in a recess in the plug housing The exemplary embodiment according to FIGS. 13 to 15 shows a further socket part which has plug sockets with the country standards Denmark 119, India 121 and Israel 123.

The adapter set is composed of a plug part 13 and a socket part 15. The plug part 13 is equipped with at least one three-pole plug contact 20, 30, 40 or 50 of a particular country standard at one end and a three-pole safety plug socket 17 at the other end of the adapter set 11. The socket part 15 is equipped with a three-pole safety plug 19 and a three-pole multi-way plug socket 16 of various country standards. The adapter set 11 comprises only a single safety plug 19, namely the plug formed on the socket part 15. A precautionary measure is taken that the polarisation of the multi-way plug socket corresponds to the polarisation of the plug contacts.

The invention claimed is:

1. An adapter set for use as an adapter plug between a plug socket and a plug of different standards, comprising:

a first adapter having a first housing comprising a plug part of a first standard, a plurality of three-pole plug contacts and a three-pole safety plug socket of at least a German (DE) standard, the DE standard safety plug socket comprising a generally cylindrically-shaped recess, a pair of plug-in holes for receiving phase and neutral conductor pins, the plurality of three-pole plug contacts being of at least a second standard, a second adapter having a second housing comprising a socket part with a threepole safety plug of at least the DE standard, the DE standard safety plug comprising a generally cylindrically-shaped plug-in body and a cylindrical phase pin and a cylindrical neutral conductor pin extending from the plugin body, and a three-pole multi-way plug socket whereby the plug part of the first adapter and the socket part of the second adapter are configured to cooperate with each other to produce an electrical connection between the plurality of three-pole plug contacts of the plug part, which comprises three-pole contacts of country standards other than the DE standard, and the three-pole multi-way plug socket of the socket part, which comprises plug sockets of country standards other than the DE standard, and a United Kingdom (UK) plug contact comprising a conductor pin and a phase pin, each of a generally rectangular shape, in a parallel relationship to one another, a United States (US) plug contact comprising a conductor pin and a phase pin, each of generally rectangular shape, in a parallel relationship to one another and an Australia (AU) plug contact comprising a conductor pin and a phase pin, each of a generally rectangular shape, in an angled relationship to one another, each of the UK, US and AU plug contacts having a ground pin with a common plane of symmetry through each of the ground pins thereof, each ground pin for the UK and AU plug contacts arranged on the same side of the respective phase and neutral conductor pins, and the ground pin of the US plug contact arranged on the other side of the phase and neutral conductor pins thereof.

2. The adapter set of claim 1, further comprising at least one precautionary measure configured to only allow the three-pole safety plug to be plugged in one position into the safety plug socket.

3. The adapter set of claim 1, wherein the plurality of three-pole plug contacts are of different standards and are displaceably mounted relative to the first housing of the plug part and are configured to be movable from a passive position within the first housing to an active position outside of the housing.

4. The adapter set of claim 3, further comprising a Swiss (CH) plug comprising a CH plug-in body, comprising a generally hexagonal body, the CH plug-in body configured to be pushed into the first housing and pushed out therefrom, pins of the CH plug configured to be pushed along a displacement path into the CH plug-in body into a passive position and to be pushed out from the CH plug-in body into an active position.

5. The adapter set of claim 4, wherein a displacement path of the CH plug extends proximate to the safety plug socket.

6. The adapter set of claim 1, wherein the multiway plug socket further comprises a plurality of plug sockets having a plurality of terminals arranged within a plug-in body of a safety plug.

7. The adapter set of claim 1, wherein the safety plug socket is configured with a ground pin of a French (FR) standard, comprising a generally cylindrical pin extending from a bottom surface of the safety plug socket.

8. The adapter set of claim 6, wherein, with respect to a particular plug standard, an orientation of the phase, neutral conductor and ground of the plurality of plug sockets in the socket part are arranged the same as a plurality of corresponding pins of the plug contacts of the particular standard.

9. The adapter set of claim 1, wherein a protrusion is formed on the plug part and a recess for receiving the protrusion is formed on the socket part, so that the socket part can only be plugged in one position into the plug part.

10. The adapter set of claim 1, further comprising a FR ground pin comprising a generally cylindrical pin extending from a bottom surface of the safety plug socket located in the common plane of symmetry and on the same side as the ground pin of the US plug contact.

11. The adapter set of claim 1, wherein a sliding contact is formed between a ground pin of one of the plurality of three-pole plug contacts and a sliding bearing.

12. The adapter set of claim 11, wherein the sliding bearing comprises a pin arranged with respect to the safety plug socket in the plug part in such a way that an extension of the sliding bearing provides a FR ground pin projecting into the safety plug socket.

13. The adapter set of claim 12, wherein a front of the sliding bearing is fixed at in the housing of the plug part and a rear of the sliding bearing is fixed in a base of the safety plug socket.

14. The adapter set according to claim 13, wherein the FR ground pin is an extension of the sliding bearing.

15. The adapter set of claim 1, wherein the adapter set is comprised of at least two first adapters.

16. An adapter set for use as an adapter plug between a plug socket and a plug of different standards, comprising:

a first adapter having a first housing comprising a plug part of a first standard, a plurality of three-pole plug contacts and a three-pole safety plug socket of at least a German (DE) standard, the DE standard safety plug socket comprising a generally cylindrically-shaped recess, a pair of plug-in holes for receiving phase and neutral conductor pins, the plurality of three-pole plug contacts being of at least a second standard, a second adapter having a second housing comprising a socket part with a threepole safety plug of at least the DE standard, the DE standard safety plug comprising a generally cylindrically-shaped plug-in body and a cylindrical phase pin and a cylindrical neutral conductor pin extending from the plugin body, and a three-pole multi-way plug socket whereby the plug part of the first adapter and the socket part of the second adapter are configured to cooperate with each other to produce an electrical connection between the plurality of three-pole plug contacts of the plug part, which comprises three-pole contacts of country standards other than the DE standard, and the three-pole multi-way plug socket of the socket part, which comprises plug sockets of country standards other than the DE standard, and a sliding contact formed between a ground pin of one of the plurality of three-pole plug contacts and a sliding bearing.

17. The adapter set of claim 16, further comprising at least one precautionary structure configured to only allow the three-pole safety plug to be plugged in one position into the safety plug socket.

18. The adapter set of claim 16, wherein the plurality of three-pole plug contacts are of different standards and are displaceably mounted relative to the first housing of the plug part and are configured to be movable from a passive position within the first housing to an active position outside of the housing.

19. The adapter set of claim 18, further comprising a Swiss (CH) plug comprising a CH plug-in body, comprising a generally hexagonal body, the CH plug-in body configured to be pushed into the first housing and pushed out therefrom, pins of the CH plug configured to be pushed along a displacement path into the CH plug-in body into a passive position and to be pushed out from the CH plug-in body into an active position.

20. The adapter set of claim 19, wherein a displacement path of the CH plug extends proximate to the safety plug socket.

21. The adapter set of claim 16, wherein the multi-way plug socket further comprises a plurality of plug sockets having a plurality of terminals arranged within a plug-in body of a safety plug.

22. The adapter set of claim 21, wherein, with respect to a particular plug standard, an orientation of the phase, neutral conductor and ground of the plurality of plug sockets in the socket part are arranged the same as a plurality of corresponding pins of the plug contacts of the particular standard.

23. The adapter set of claim 16, wherein the safety plug socket is configured with a ground pin of the French (FR) standard, comprising a generally cylindrical pin extending from a bottom surface of the safety plug socket.

24. The adapter set of claim 16, wherein a protrusion is formed on the plug part and a recess for receiving the protrusion is formed on the socket part, so that the socket part can only be plugged in one position into the plug part.

25. The adapter set of claim 16, further comprising a United Kingdom (UK) plug comprising a conductor pin and a phase pin, each of a generally rectangular shape, in a parallel relationship to one another, a United States (US) plug comprising a conductor pin and a phase pin, each of generally rectangular shape, in a parallel relationship to one another and an Australia (AU) plug comprising a conductor pin and a phase pin, each of a generally rectangular shape, in an angled relationship to one another, each of the UK, US and AU plugs having a ground pin with a common plane of symmetry through each of the ground pins thereof, each ground pin for the UK and AU plug contacts arranged on the same side of the respective phase and neutral conductor pins, and the ground pin of the US plug contact arranged on the other side of the phase and neutral conductor pins thereof.

26. The adapter set of claim 25, further comprising a FR ground pin comprising a generally cylindrical pin extending from a bottom surface of the safety plug socket located in the common plane of symmetry and on the same side as the ground pin of the US plug contact.

27. The adapter set of claim 16, wherein the sliding bearing comprises a pin arranged with respect to the safety plug socket in the plug part in such a way that an extension of the sliding bearing provides a FR ground pin projecting into the safety plug socket.

28. The adapter set of claim 27, wherein a front of the sliding bearing is fixed at in the housing of the plug part and a rear of the sliding bearing is fixed in a base of the safety plug socket.

29. The adapter set according to claim 28, wherein the FR ground pin is an extension of the sliding bearing.

30. The adapter set of claim 16, wherein the adapter set is comprised of at least two first adapters.

* * * * *